US008302695B2

(12) United States Patent
Simpson et al.

(10) Patent No.: US 8,302,695 B2
(45) Date of Patent: Nov. 6, 2012

(54) DOWNHOLE SYSTEMS AND METHODS FOR DELIQUIFACTION OF A WELLBORE

(75) Inventors: David A. Simpson, Farmington, NM (US); Michael D. Scull, Bayfield, CO (US)

(73) Assignee: BP Corporation North America Inc., Houston, TX (US)

( * ) Notice: Subject to any disclaimer, the term of this patent is extended or adjusted under 35 U.S.C. 154(b) by 445 days.

(21) Appl. No.: 12/580,820

(22) Filed: Oct. 16, 2009

(65) Prior Publication Data

US 2010/0101798 A1 Apr. 29, 2010

Related U.S. Application Data

(60) Provisional application No. 61/107,856, filed on Oct. 23, 2008.

(51) Int. Cl.
*E21B 43/12* (2006.01)
*F04F 5/00* (2006.01)
*F04F 5/46* (2006.01)

(52) U.S. Cl. ..... 166/372; 166/105; 166/68; 417/151; 417/172; 417/198

(58) Field of Classification Search ..... 417/171, 417/172, 174, 177, 178, 198, 151; 166/105, 166/68, 372
See application file for complete search history.

(56) References Cited

U.S. PATENT DOCUMENTS

| | | | | | |
|---|---|---|---|---|---|
| 1,195,915 | A | * | 8/1916 | Damrow | 417/151 |
| 1,782,310 | A | * | 11/1930 | Overstreet | 417/191 |
| 2,183,623 | A | * | 12/1939 | Ross | 417/195 |
| 2,631,774 | A | * | 3/1953 | Plummer, Jr. | 417/151 |
| 3,182,726 | A | | 5/1965 | Stone | |
| 3,268,004 | A | | 8/1966 | Kiel | |
| 3,887,008 | A | * | 6/1975 | Canfield | 166/267 |
| 4,545,731 | A | | 10/1985 | Canalizo et al. | |
| 4,708,595 | A | | 11/1987 | Maloney et al. | |
| 4,807,814 | A | * | 2/1989 | Douche et al. | 239/428 |
| 5,022,427 | A | | 6/1991 | Churchman et al. | |
| 5,083,609 | A | * | 1/1992 | Coleman | 166/68 |
| 5,113,939 | A | | 5/1992 | Ross et al. | |
| 5,372,190 | A | * | 12/1994 | Coleman | 166/68 |
| 5,875,852 | A | | 3/1999 | Floyd et al. | |
| 6,082,452 | A | | 7/2000 | Shaw et al. | |
| 2003/0024704 | A1 | | 2/2003 | Hirsch et al. | |
| 2006/0076140 | A1 | | 4/2006 | Rouen | |

* cited by examiner

*Primary Examiner* — Giovanna Wright
(74) *Attorney, Agent, or Firm* — Barbara A. Fisher

(57) ABSTRACT

A downhole assembly for deliquifying a wellbore. In an embodiment, the assembly comprises a nozzle section including a converging nozzle and a diverging nozzle in fluid communication with the converging nozzle. In addition, the assembly comprises a throat section including a convergent throat passage proximal the diverging nozzle and a cylindrical throat passage distal the diverging nozzle and extending axially from the convergent throat passage. The convergent throat passage and the cylindrical throat passage are in fluid communication with the diverging nozzle. Further, the assembly comprises a diffuser section coaxially aligned with the throat section. The diffuser section includes a divergent diffuser passage extending axially from the straight throat passage.

31 Claims, 11 Drawing Sheets

DOWNHOLE SYSTEMS AND METHODS FOR DELIQUIFACTION OF A WELLBORE

CROSS-REFERENCE TO RELATED APPLICATIONS

This application claims the benefit under 35 U.S.C. §119 (e) of U.S. Provisional Patent Application Ser. No. 61/107,856 filed Oct. 23, 2008 and entitled "Downhole Ejector for Deliquification of a Well," which is hereby incorporated herein by reference in its entirety.

STATEMENT REGARDING FEDERALLY SPONSORED RESEARCH OR DEVELOPMENT

Not Applicable.

BACKGROUND

1. Field of the Art

The disclosure relates generally to the field of downhole tools. More specifically, the present disclosure relates to apparatus, systems, and methods for the deliquification of a hydrocarbon producing well.

2. Description of the Related Art

Geological structures that yield gas typically produce water and other liquids that accumulate at the bottom of the wellbore. As the liquid level in the wellbore rises, the liquid may begin to cover the gas producing portion of the formation, thereby restricting the flow of gas. Consequently, it may become necessary to remove the accumulated liquid from the wellbore to restore the flow of gas from the formation.

In some hydrocarbon producing wells that produce both gas and liquid, the formation gas pressure and volumetric flow rate are sufficient to lift the produced liquids to the surface. In such wells, accumulation of liquids in the wellbore generally does not hinder gas production. However, in other hydrocarbon producing wells, the formation gas pressure and volumetric flow rate are not sufficient to lift the produced liquids to the surface, and thus, many of these wells employ means to lift or pump the accumulated liquid to the surface. In many cases, the hydrocarbon well may initially produce gas with sufficient pressure and volumetric flow to lift produced liquids to the surface, however, over time, the produced gas pressure and volumetric flow rate decrease until they are no longer capable of lifting the produced liquids to the surface. Once the liquid will no longer flow with the produced gas to the surface, the well will eventually become "loaded" as the liquid hydrostatic head begins to overcome the lifting action of the gas flow, at which point the well is "killed" or "shuts itself in." Usually, the well will remain shut-in until the downhole pressure builds up to a value sufficient to overcome the liquid hydrostatic head, whereupon the well will again flow and produce both gas and liquid to the surface until the accumulation of liquid once again produces a hydrostatic head sufficient to overcome the produced gas pressure and volumetric flow, at which point the well shuts itself in once again. To disrupt the periodic cycle of gas production followed by well shut-in, a downhole pump may be advantageously employed to ensure the well is continuously producing, even when the downhole gas pressure and volumetric flow rate are insufficient by themselves to lift the accumulated liquid in the wellbore to the surface.

Consequently, there is a need for an improved apparatus or tool for dewatering low pressure wells.

BRIEF SUMMARY

These and other needs in the art are addressed in one embodiment by a downhole assembly for deliquifying a wellbore. In an embodiment, the assembly comprises a nozzle section including a converging nozzle and a diverging nozzle in fluid communication with the converging nozzle. In addition, the assembly comprises a throat section including a convergent throat passage proximal the diverging nozzle and a cylindrical throat passage distal the diverging nozzle and extending axially from the convergent throat passage. The convergent throat passage and the cylindrical throat passage are in fluid communication with the diverging nozzle. Further the assembly comprises a diffuser section coaxially aligned with the throat section. The diffuser section includes a divergent diffuser passage extending axially from the straight throat passage.

These and other needs in the art are addressed in another embodiment by a system for lifting an accumulated fluid from a wellbore to the surface. In an embodiment, the system comprises a first pipe string extending into the wellbore. In addition, the system comprises a second pipe string extending into the wellbore. The second pipe string has an inner flow passage and is disposed within the first pipe string. Further, the system comprises a bottomhole assembly having an upper end coupled to the first pipe string, a lower end including a fluid inlet, and a longitudinal axis. The bottomhole assembly comprises a tubular assembly extending from the upper end to the lower end. Further, the bottomhole assembly comprises an ejector assembly disposed within the tubular assembly. The ejector assembly includes a nozzle section including a converging nozzle and a diverging nozzle extending axially from the converging nozzle. The converging nozzle and the diverging nozzle are in fluid communication with the inner flow passage of the second pipe string. Moreover, the ejector assembly includes a throat section coupled to the nozzle section. The throat section is axially positioned below the nozzle section and includes a convergent throat passage proximal the diverging nozzle and a cylindrical throat passage extending axially from the convergent passage. The convergent passage and the straight passage are in fluid communication with the diverging nozzle.

These and other needs in the art are addressed in another embodiment by a method for deliquifying a well. In an embodiment, the method comprises (a) providing a downhole ejector assembly having a longitudinal axis. The ejector assembly includes a nozzle section including a converging nozzle and a diverging nozzle extending axially from the converging nozzle. In addition, the ejector assembly includes a throat section coaxially aligned with the diverging nozzle. The throat section includes a convergent throat passage proximal the diverging nozzle. Further, the ejector assembly includes a diffuser section coaxially aligned with the throat section. The diffuser section includes a divergent diffuser passage. Still further, the method comprises (b) flowing a motive gas through the converging nozzle. Moreover, the method comprises (c) flowing the motive gas through the diverging nozzle after (b). In addition, the method comprises (c) accelerating the motive gas to a supersonic velocity. Further, the method comprises (d) flowing the motive gas through the convergent throat section after (b).

Embodiments of tools, apparatus, systems and methods for deliquification or dewatering a well are disclosed herein. More specifically, embodiments of downhole ejectors are disclosed which incorporate novel combinations of nozzle geometries and throat configurations. The disclosed nozzle geometries and throat configurations enable the supersonic throughput of motive fluid for efficient entrainment and pumping of accumulated fluids from a wellbore.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION

Figure 1:
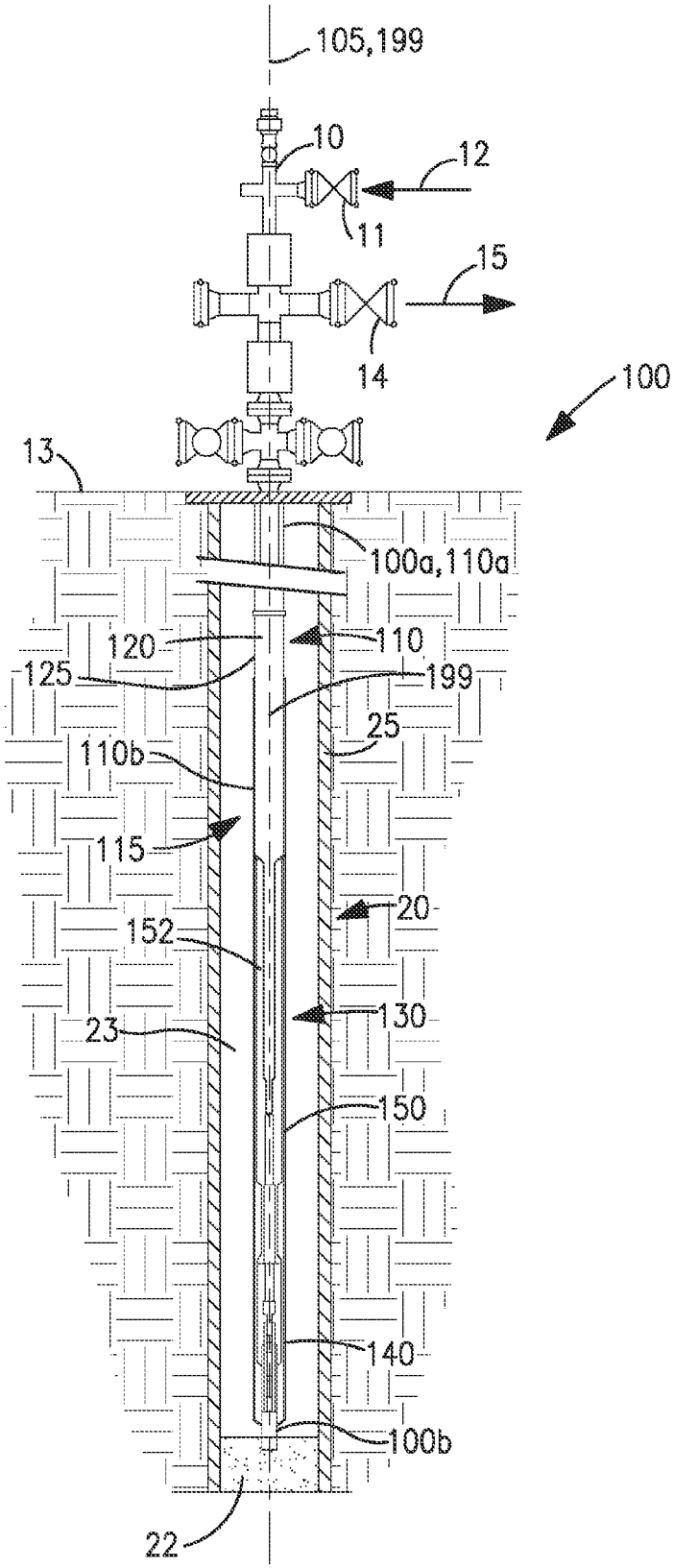
FIG. 1 is a schematic partial cross-sectional view of an embodiment of a downhole deliquification system in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis (e.g., the pipe string axis), while the terms "radial" and "radially" generally mean perpendicular to the central or longitudinal axis. For instance, an axial distance refers to a distance measured along or parallel to the central or longitudinal axis, and a radial distance refers to a distance measured perpendicularly from the central or longitudinal axis. Further, the terms "coaxial" and "coaxially" generally refer to the relative orientation of two structures or components that have coincident central or longitudinal axes. Still further, the terms "tubing," "tubing string," "tubular," "tubular assembly," "pipe," and "pipe string" refer to any length of tubing or conduit, which may be made from a single tube or conduit or multiple tubes or conduits coupled together.

Referring now to FIG. 1, an embodiment of a deliquification system 100 in accordance with the principles described herein is shown extending from a wellhead 10 at the surface 13 into a wellbore 20 through casing 25. Deliquification system 100 has a central or longitudinal axis 105, a first or upper end 100*a* coupled to wellhead 110 and a second or lower end 100*b* extending to accumulated liquids 22 in wellbore 20. In general, deliquification system 100 is employed to remove and lift at least a portion of accumulated liquids 22 from wellbore 20 to the surface 13 to enhance the recovery of gas from wellbore 20. The portion of accumulated liquid 22 removed and lifted by system 100 may also be referred to herein as the "suction fluid."

Figure 2:
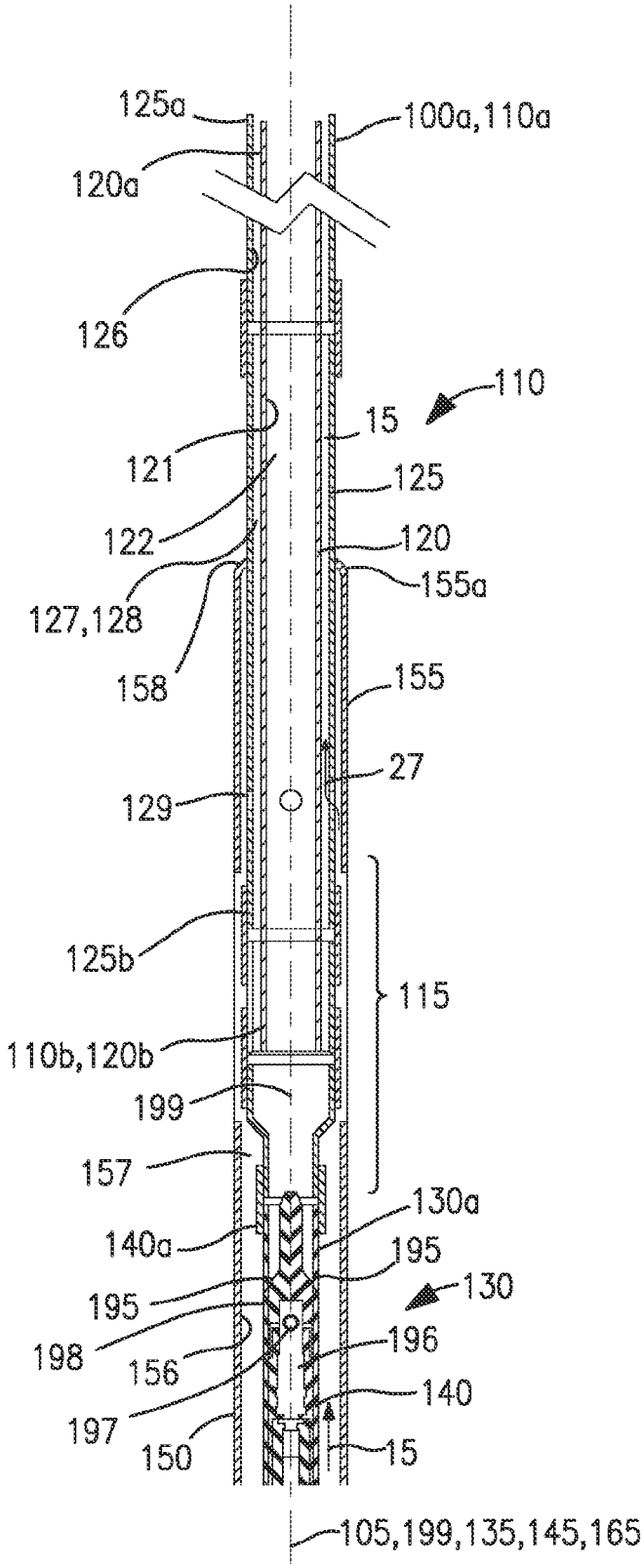
FIG. 2 is an enlarged partial cross-sectional view of the deliquification system of FIG. 1.

Referring now to FIGS. 1 and 2, deliquification system 100 includes a tubing string 110 and a bottom-hole assembly (BHA) 130. Tubing string 110 has a central or longitudinal axis 199 coincident with axis 105, a first or upper end 110*a* coincident with end 100*a* of system 100, and a second or lower end 110*b* axially coupled end-to-end with BHA 130 with a coupling 115. Further, tubing string 110 comprises a radially inner pipe string 120 coaxially disposed within a radially outer pipe string 125. Inner and outer pipe strings 120, 125, respectively, each extend the length of tubing string 110 generally between ends 110*a*, 110*b*, and thus, each pipe string 120, 125 has an upper end 120*a*, 125*a*, respectively, proximal upper end 110*a* of tubing string 110, and a lower end 120*b*, 125*b*, respectively, proximal lower end 110*b* of tubing string 110.

As best shown in FIG. 2, inner pipe string 120 includes a central through bore 121 axially extending between ends 120*a*, 120*b* and defining a fluid flow passage 122. Outer pipe string 125 also includes a central through bore 126 axially extending between ends 125*a*, 125*b*; pipe string 120 is disposed within bore 126. The outer radius of inner pipe string 120 is less than the inner radius of outer pipe string 125, resulting in the formation of an annulus 127 radially disposed between pipe strings 120, 125. Annulus 127 defines a fluid flow passage 128 in fluid communication with a plurality of ports 129 extending radially through pipe string 125 proximal lower end 125*b*. In this embodiment, four uniformly angularly spaced ports 129 are provided, however, in general, any suitable number of ports (e.g., ports 129) may be provided in pipe string 125 proximal lower end 125*b*.

Referring again to FIG. 1, wellhead 10 includes an inlet 11 in fluid communication with fluid flow passage 122, and an outlet 14 in fluid communication with fluid flow passage 128. As will be explained in more detail below, during operation of deliquification system 100, a power or motive fluid, represented by arrow 12, is pumped under pressure into inlet 11 and down fluid flow passage 122 to BHA 130, and an exhaust fluid, represented by arrow 15, is pumped up from BHA 130 through fluid flow passage 128 to outlet 14. Exhaust fluid 15 comprises a combination of motive fluid 12 and a portion of accumulated fluids 22 lifted to the surface 13 with deliquification system 100. Typically, accumulated fluid 22 is predominantly water, and on occasion, may include small volumes of liquid hydrocarbons.

Figure 3:
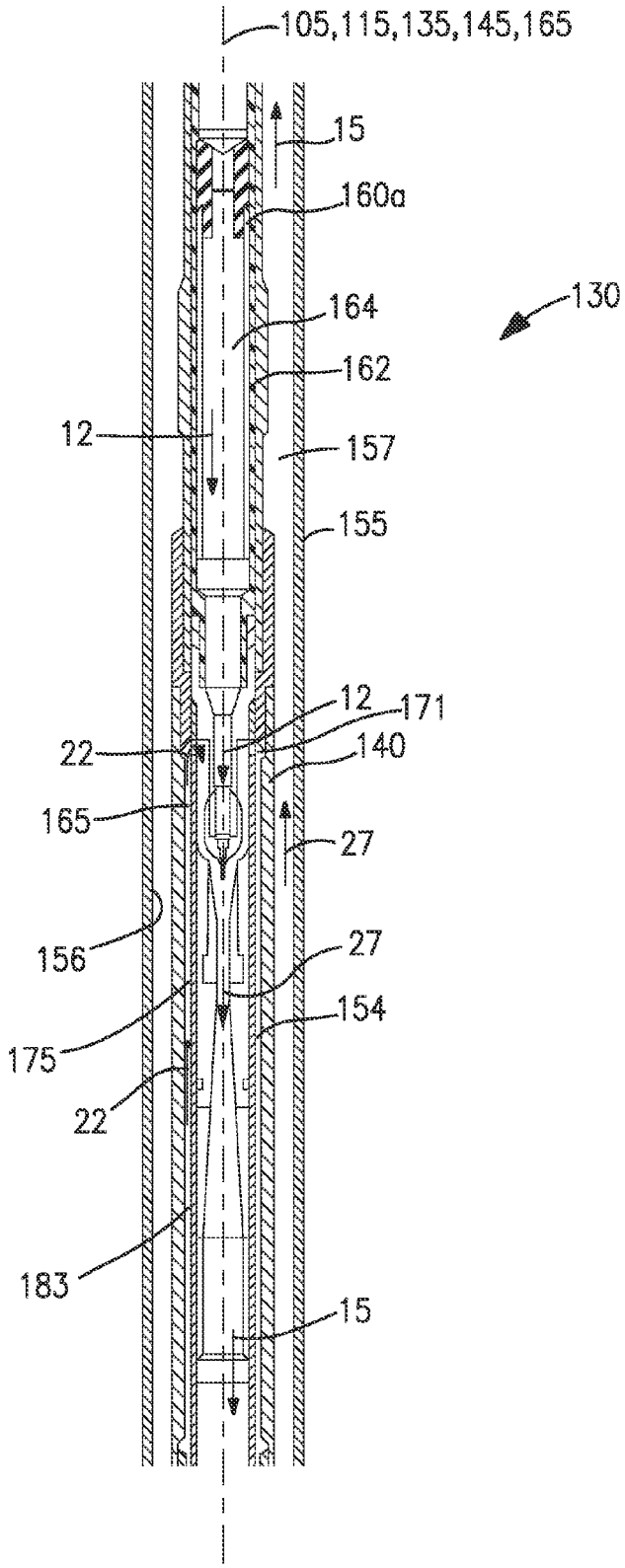
FIG. 3 is an enlarged partial cross-sectional view of the deliquification system of FIG. 1.
Figure 4:
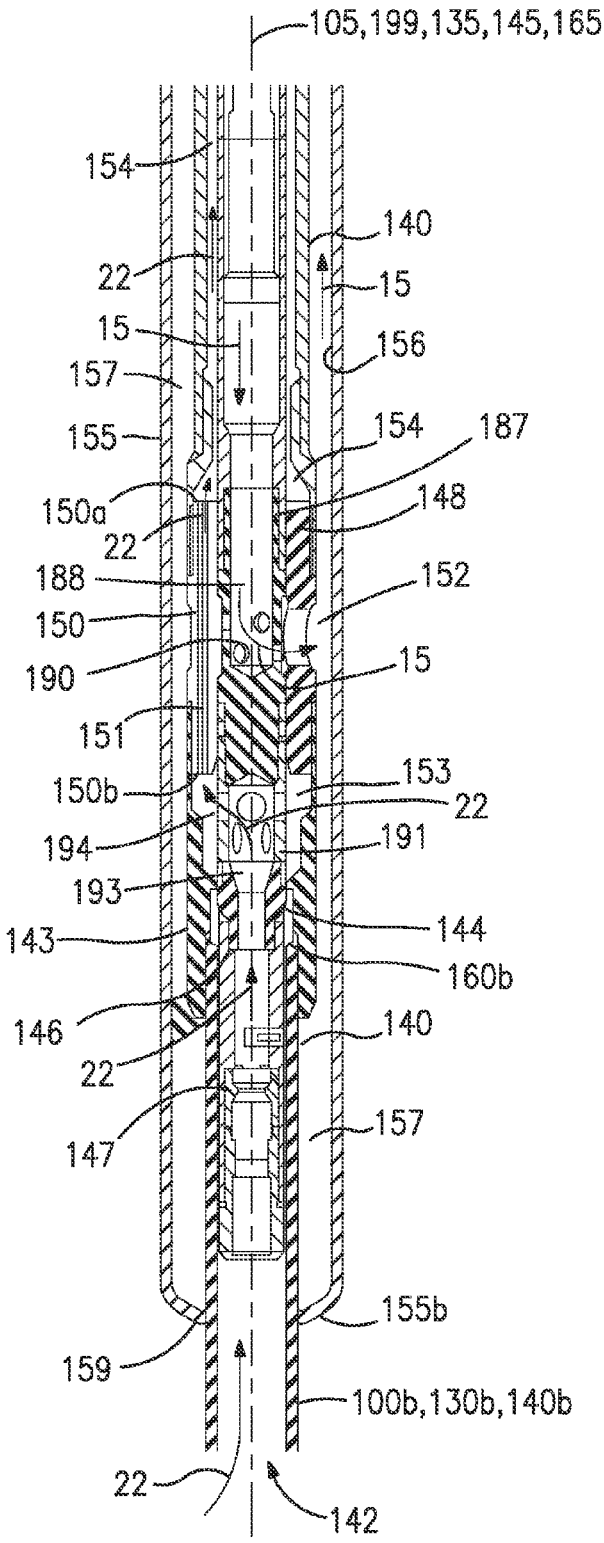
FIG. 4 is an enlarged partial cross-sectional view of the deliquification system of FIG. 1.
Figure 5:
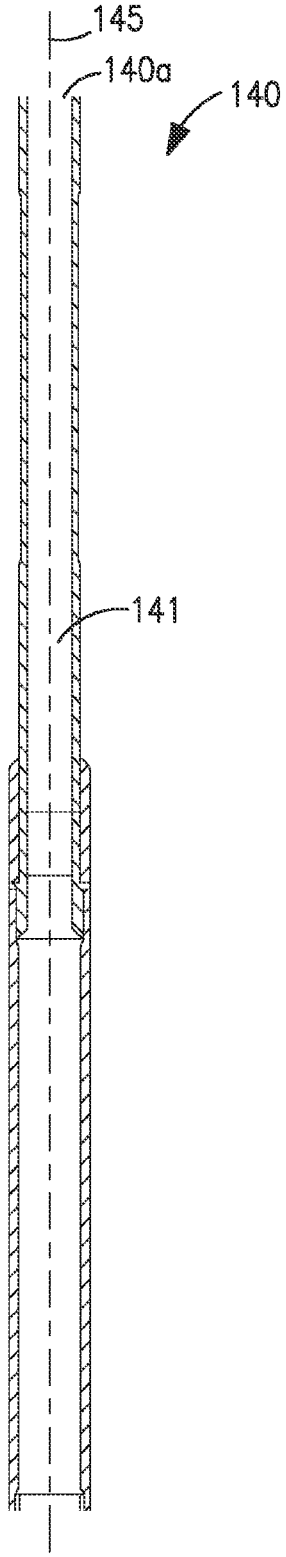
FIGS. 5 and 6 are enlarged partial cross-sectional views of the tubular assembly of FIG. 1.

Referring now to FIGS. 2-4, BHA 130 has a central or longitudinal axis 135 coincident with axes 105, 199, a first or upper end 130*a* coupled to lower end 110*b* of tubing string 110 with coupling 115, and a second or lower end 130*b* coincident with lower end 100*b* of system 100. For purposes of clarity, in FIGS. 2-4, different sections or portions of BHA 130 are shown. In particular, the upper portion of BHA 130 including upper end 130*a* is shown in FIG. 2, the lower portion of BHA 130 including lower end 130*b* is shown in FIG. 4, and the portion of BHA 130 extending between the upper and lower portions illustrated in FIGS. 2 and 4 is shown in FIG. 3. Thus, FIGS. 2-4 represent different snapshots of BHA 130 moving axially downward from upper end 130*a* to lower end 130*b*.

Referring now to FIGS. 2-6, BHA 130 comprises a tubular assembly 140 and an ejector assembly 160 coaxially disposed within tubular assembly 140 (FIGS. 2-4). Tubular assembly 140 has a central or longitudinal axis 145 coincident with axis 135, a first or upper end 140*a* coupled to lower end 110*b* of tubing string 110 with coupling 115, a second or lower end 140*b* coincident with end 130*b*, and a central passage 141 extending axially between ends 140*a, b*. Lower end 140*b* includes an inlet 142. In some embodiments, a screen or other filtering device may be placed across inlet 142 to restrict or prevent the uptake of large solids from the wellbore. During pumping operations, suction fluid 22 in wellbore 20 is sucked into inlet 142 and lifted to the surface 13 with system 100. Consequently, inlet 142 may also be referred to as suction fluid inlet 142.

Referring now to FIGS. 2-6, BHA 130 comprises a tubular assembly 140 and an ejector assembly 160 coaxially disposed within tubular assembly 140 (FIGS. 2-4). Tubular assembly 140 has a central or longitudinal axis 145 coincident with axis 135, a first or upper end 140*a* coupled to lower end 110*b* of tubing string 110 with coupling 115, a second or lower end 140*b* coincident with end 130*b*, and a central passage 141 extending axially between ends 140*a, b*. Lower end 140*b* includes an inlet 142. In some embodiments, a screen or other filtering device may be placed across inlet 142 to restrict or prevent the uptake of large solids from the wellbore. During pumping operations, suction fluid 22 in wellbore 20 is sucked into inlet 142 and lifted to the surface 15 with system 100. Consequently, inlet 142 may also be referred to as suction fluid inlet 142.

As best shown in FIGS. 2-4, a tubular exhaust shroud 155 is coaxially disposed about tubular assembly 140 and lower end 110*b* of tubing string 110. Shroud 155 extends axially between a first or upper end 155*a* disposed about tubular string 110 above adapter 115 and a second or lower end 155*b* disposed about tubular assembly 140 proximal end 140*b*. In addition, shroud 155 includes a central through bore 156 extending axially from end 155*a* to end 155*b*. Between ends 155*a, b*, the inner radius of shroud 155 is greater than the outer radii of tubular string 125, tubular assembly 140, and adapter 115, thereby defining an annulus 157 extending axially between ends 155*a, b* and radially disposed between shroud 155 and pipe string 125, tubular assembly 140, and adapter 115. As best shown in FIGS. 2 and 4, upper end 155*a* of shroud 155 engages the radially outer surface of outer pipe string 125, and lower end 155*b* of shroud 155 engages the radially outer surface of tubular assembly 140. In particular, an annular seal 158 is formed between upper end 155*a* and pipe string 125, and an annular seal 159 is formed between lower end 155*b* and tubular assembly 140. Seals 158, 159 restrict and/or prevent fluid communication between annulus 157 and an annulus 23 formed radially between system 100 and casing 25 of wellbore 20 (FIG. 1).

Figure 6:
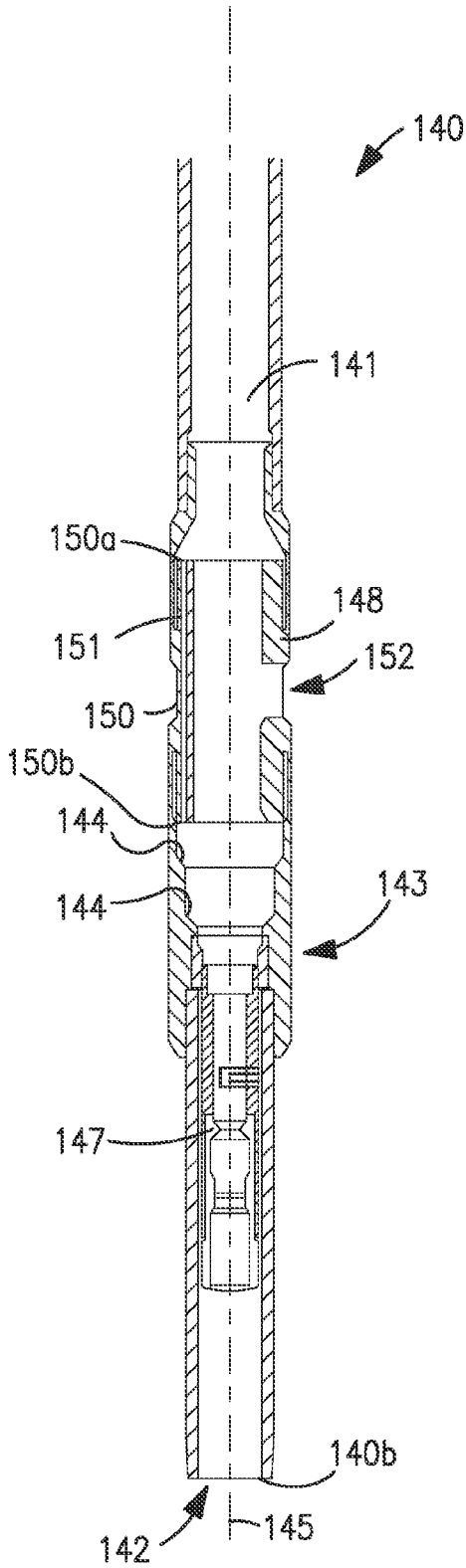

Referring now to FIGS. 4 and 6, tubular assembly 140 includes a landing sub assembly 143 that radially and axially locates ejector assembly 160 within passage 141. Consequently, landing sub assembly 143 may also be referred to as locator 143. In this embodiment, the radially inner surface of landing sub assembly 143 includes a plurality of annular inverted frustoconical shoulders 144 and a plurality of annular planar shoulders 146 disposed axially below shoulders 144. Moving axially downward in passage 141, shoulders 144, 146 successively reduce the inner diameter of passage 141. During assembly of BHA 130, ejector assembly 160 is coaxially inserted into passage 141 at end 140*a* and axially advanced into passage 141. The lower end of ejector assembly 160 engages and slides across inverted frustoconical shoulders 144, which radially urges ejector assembly 160 toward the center of tubular assembly 140. The axial advancement of ejector assembly 160 through passage 141 continues until the lower end of ejector assembly 160 axially abuts shoulders 146, thereby stopping continued axial advancement of ejector assembly 160 relative to tubular assembly 140. Thus, upon assembly, the lower end of ejector assembly 160 axially abuts shoulders 146 and is seated against shoulders 144.

In this embodiment, a choke 147 is disposed within passage 141 and axially positioned between landing sub assembly 143 and inlet 142. Choke 147 regulates the flow rate of suction fluid 22 flowing into inlet 142 and through system 100.

Referring still to FIGS. 4 and 6, tubular assembly 140 also includes a fluid flow separation sub 148 axially positioned between landing sub assembly 143 and upper end 140*a*. Flow separation sub 148 comprises a fluid passage 150 and an outlet port 152. Passage 150 has a central or longitudinal axis 151, an upper end 150*a* axially disposed above port 152, and a lower end 150*b* axially disposed below port 152. Axis 151 and passage 150 are parallel to axis 145, but radially offset from axis 145. Outlet port 152 extends radially through tubular assembly 140 from passage 141 to annulus 157 (FIG. 4). Outlet port 152 is angularly and circumferentially spaced from passage 150. Further, as will be described in more detail below, during operation of system 100, suction fluid 22 entering inlet 142 flows axially upward through choke 147 into end 150*b*, through passage 150, and out of end 150*a*, thereby bypassing outlet port 152. Consequently, end 150*b* may also be referred to as fluid inlet 150*b*, and end 150*a* may also be referred to as fluid outlet 150*a*.

Referring now to FIGS. 2-4, 7, and 8, ejector assembly 160 is coaxially disposed within passage 141 of tubular assembly 140, and includes a central axis 165, a first or upper end 160*a*, and a second or lower end 160*b*. Ejector assembly 160 comprises a motive fluid inlet section 162, a nozzle section 165, a throat section 175, a divergent diffuser section 183, pumped or mixed fluid outlet section 187, and a suction fluid inlet section 191. Motive fluid inlet section 162 extends axially from end 160*b* to nozzle section 165; throat section 175 extends axially from nozzle section 165 to diffuser section 183; and fluid outlet section 187 extends axially from diffuser section 183. Suction fluid inlet section 191 extends axially from end 160*b*, and is axially spaced and separated from outlet section 187. As will be described in more detail below, suction fluid 22 entering system 100 via inlet 142 flows through suction fluid inlet section 191. Further, motive fluid 12 flows from wellhead 10 flows through motive fluid inlet section 162 and nozzle section 165, where motive fluid 12 is accelerated to supersonic flow speeds. In throat section 175, suction fluids 22 that previously passed through suction fluid inlet section 191 are entrained in motive fluid 12 from nozzle section 165 to form a mixture or combination of motive fluid 12 and suction fluids 22 represented by arrow 15. Exhaust fluid 15 flows though throat section 175, which maintains the supersonic fluid flow rate, to diffuser section 183, where the velocity of exhaust fluid 15 decreases. Exhaust fluid 15 then flows from diffuser section 183 to outlet section 187 where it exits ejector assembly 160.

Referring specifically to FIGS. 2-4, the radially outer diameter of ejector assembly 160 is generally uniform along its entire length measured axially between ends 160*a, b*. However, the diameter of passage 141 of tubular assembly 140 varies along its length measured axially between ends 140*a, b*. In general, the diameter of passage 141 is greater than or equal to the outer diameter of ejector assembly 160 axially between upper end 140*a* and locator 143, thereby enabling the axial insertion and positioning of ejector assembly 160 within passage 141. Along those axial portions of ejector assembly 160 where the diameter of passage 141 is substantially the same as the outer diameter of ejector assembly 160, the outer surface of ejector assembly 160 engages the inner surface of tubular assembly 140. However, along those axial portions of ejector assembly 160 where the diameter of passage 141 is greater than the outer diameter of ejector assembly 160, an annulus is formed radially between ejector assembly 160 and tubular assembly 140. In particular, a first annulus 153 and a second annulus 154 are each radially positioned between ejector assembly 160 and tubular assembly 140; annulus 153 extends axially from locator 143 to fluid flow separation sub 148, and annulus 154 extends axially from fluid flow separation sub 148 to nozzle section 165. Annuli 153, 154 are each in fluid communication with passage 150 of separation sub 148. Specifically, during operation of system 100, suction fluid 22 entering inlet 142 flows axially upward through choke 147, suction fluid inlet section 191, annulus 153, inlet 150*b*, passage 150, and outlet 150*a* to annulus 154.

Figure 7:
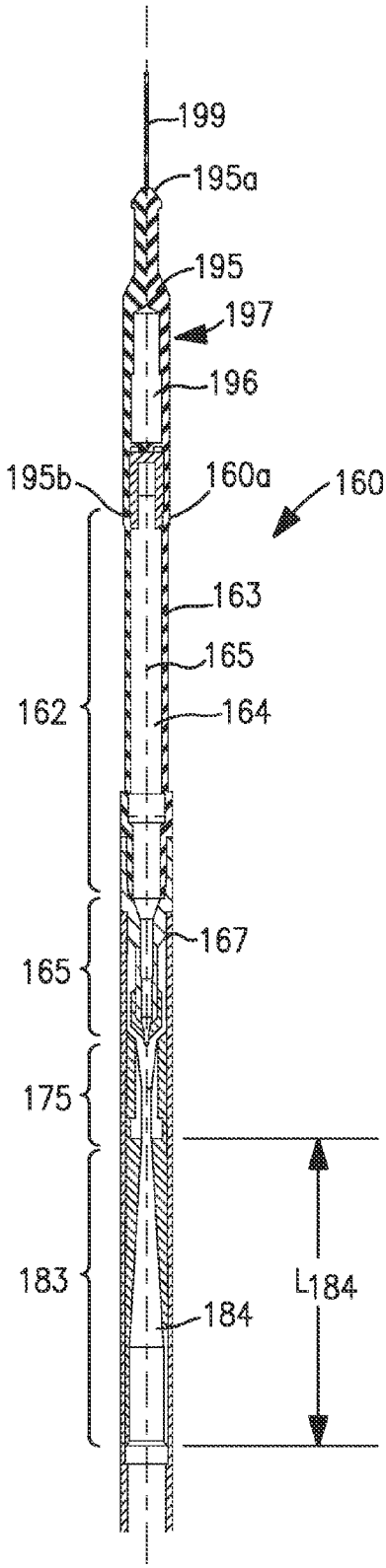
FIGS. 7 and 8 are enlarged partial cross-sectional views of the ejector assembly of FIG. 1.

Referring now to FIGS. 3 and 7, motive fluid inlet section 162 extends axially from retrieval tool 195 to nozzle section 165 and comprises an elongated tubular 163 having a central fluid passage 164 in fluid communication passage 122 of pipe string 120. Thus, inlet section 162 provides a conduit that delivers motive fluid 12 pumped from the surface to nozzle section 165.

Figure 9:
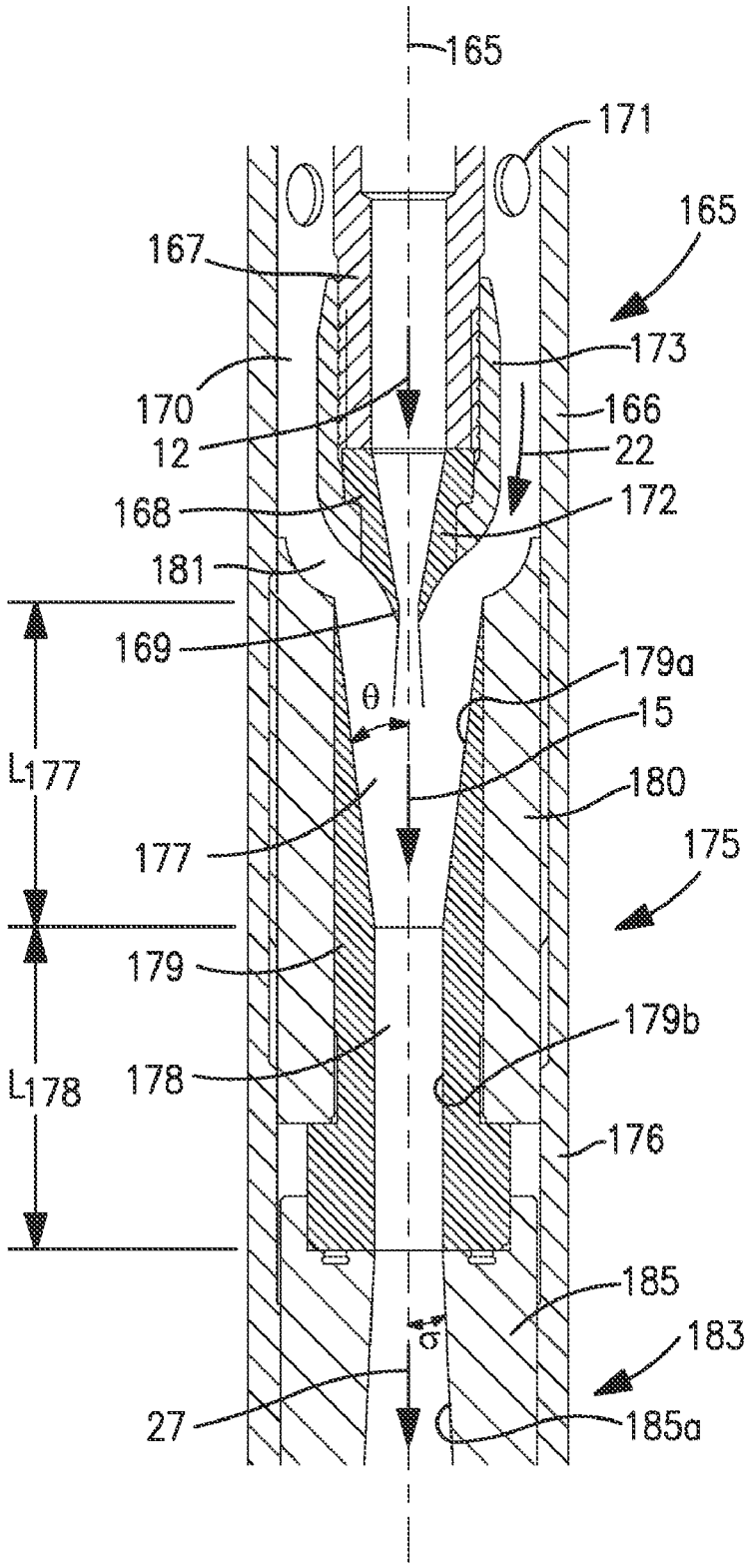
FIG. 9 is an enlarged partial cross-sectional view of the nozzle section, throat section, and divergent diffuser section of the ejector assembly of FIG. 1.

Referring now to FIGS. 3, 7, and 9, nozzle section 165 extends axially from inlet section 162 and includes a radially outer tubular housing 166, a motive fluid inlet conduit 167, a converging nozzle 168 extending axially from inlet conduit 167, and a diverging nozzle 169 extending axially from converging nozzle 168. Conduit 167 is in fluid communication with passage 164 and nozzles 168, 169. Relative to the flow of motive fluid 12, converging nozzle 168 is downstream of inlet conduit 167, and diverging nozzle 169 is downstream of converging nozzle 169. As best shown in FIG. 9, conduit 167 and nozzles 168, 169 extend axially into housing 166, but are radially spaced from housing 166. In other words, the outer diameter of conduit 167, converging nozzle 168, and diverging nozzle 169 is each less than the inner diameter of housing 166. Consequently, an annulus 170 is formed radially between housing 166 and conduit 167 and nozzles 168, 169. Housing 166 includes a plurality of suction fluid inlet ports 171, each port 171 extending radially through housing 166 from annulus 154 to annulus 170. Thus, annulus 154 is in fluid communication with annulus 170 via ports 171.

During operation of system 100, motive fluid 12 is pumped at relatively high pressure and mass flow rate to nozzle section 165. Although other suitable pressures and mass flow rates may be employed depending on system design and geometry, in one embodiment, motive fluid 12 is supplied at about 100-125 psig and 80-120 MSCF/day flow rate. Converging nozzle 168 and diverging nozzle 169 are preferably configured such that motive fluid 12, pumped from the surface 13 with a sufficient pressure and mass flow rate, is accelerated to a supersonic velocity by nozzles 168, 169. The pressure and mass flow rate of motive fluid 12 is managed and controlled at the surface 13 to achieve the preferred supersonic flow speed for motive fluid 12.

In this embodiment, converging nozzle 168 and diverging nozzle 169 are formed in one nozzle body 172 that is axially coupled end-to-end with inlet conduit 167 with a nozzle holder 173. In particular, nozzle body 172 is secured in holder 173, and then nozzle holder 173 is coaxially aligned and threaded onto inlet conduit 167. However, in general, any suitable arrangement and/or assembly of components may be employed to achieve the preferred converging-diverging nozzle arrangement.

Figure 10:
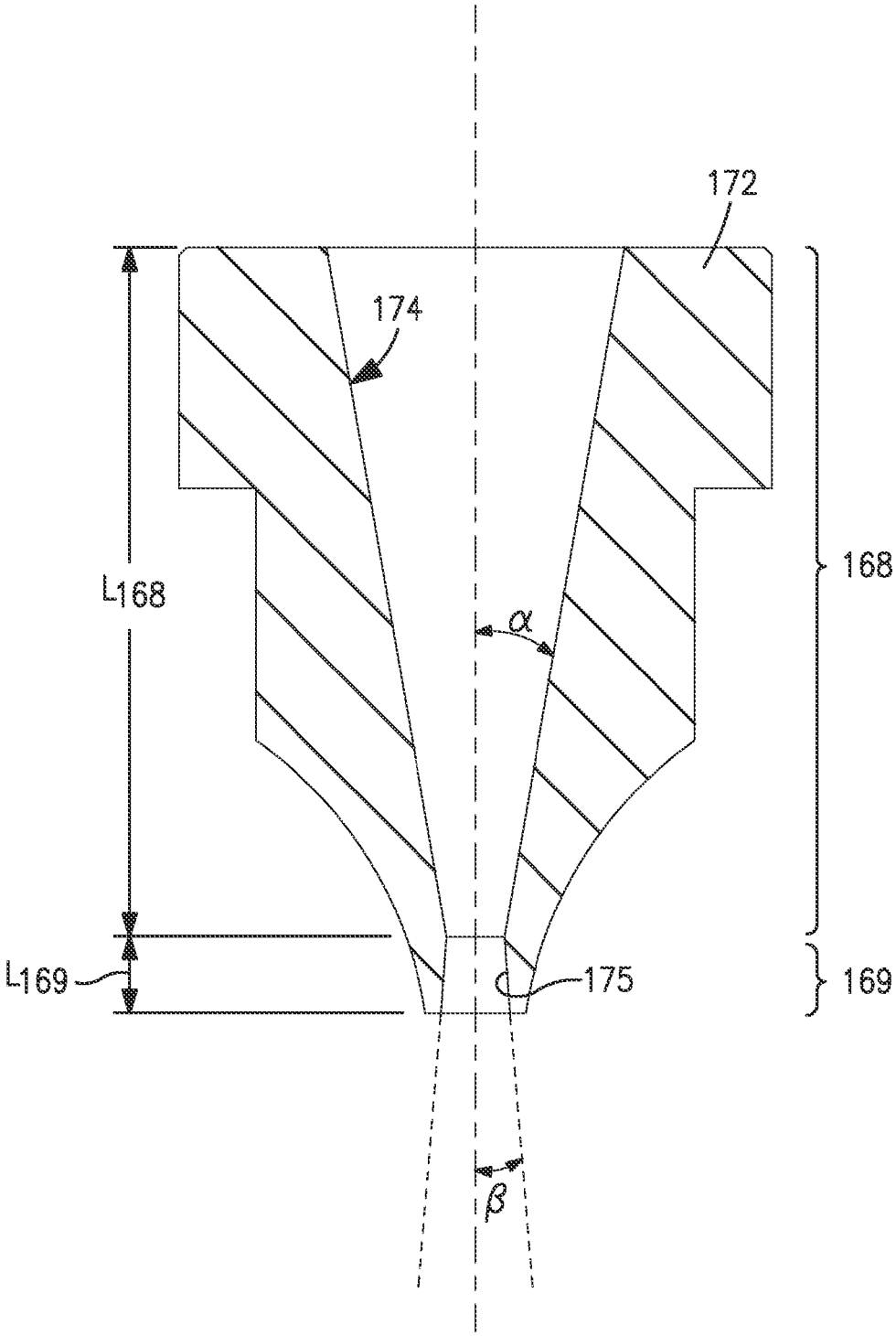
FIG. 10 is an enlarged cross-sectional view of the nozzle body of the ejector assembly of FIG. 1.

Referring now to FIG. 10, nozzle body 172 includes a radially inner inverted frustoconical surface 174 defining converging nozzle 168 and a radially inner frustoconical surface 175 defining diverging nozzle 168. Converging surface 174 is oriented at an angle $\alpha$ relative to central axis 165, and diverging surface 175 is oriented at an angle $\beta$ relative to central axis 165. Moreover, converging nozzle 168 has an axial length $L_{168}$ measured parallel to central axis 165, and diverging nozzle 169 has an axial length $L_{169}$ measured parallel to central axis 165.

In general, angle $\alpha$, $\beta$ may be any suitable angle, and axial length $L_{168}$, $L_{169}$ may be any suitable length. However, to achieve the preferred flow characteristics of motive fluid 12 (e.g., supersonic flow), angle $\alpha$ is preferably between 6° and 10°, and angle $\beta$ is preferably less than or equal to 10°. In other words, converging nozzle 168 preferably convergently tapers at an angle $\alpha$ between 6° and 10°, and diverging nozzle 169 preferably divergently tapers at an angle $\beta$ less than or equal to 10°. Further, axial length $L_{169}$ of diverging nozzle 169 is preferably between 0.01 in. and 0.5 in., more preferably between 0.02 in. and 0.1 in., and even more preferably between 0.04 in. and 0.06 in. The ratio of axial length $L_{168}$ to axial length $L_{169}$ preferably ranges from 16:1 to 20:1.

Referring again to FIGS. 3, 7, and 9, throat section 175 extends axially from nozzle section 165 and includes a radially outer tubular housing 176 axially aligned with and coupled to housing 166, a convergent throat passage 177 proximal diverging nozzle 169, and a straight or cylindrical throat passage 178 extending from convergent throat passage 177 and generally distal diverging nozzle 169. Throat passages 177, 178 are coaxially aligned with nozzles 168, 169, and are in fluid communication with nozzles 168, 169 and annulus 170.

In this embodiment, convergent throat passage 177 and cylindrical throat passage 178 are formed in a throat body 179 that is coaxially disposed within and carried by a throat carrier 180 extending radially between throat body 179 and housings 166, 176. However, in general, any suitable arrangement and/or assembly of components may be employed to achieve the preferred converging and straight geometry and arrangement of throat passages 177, 178.

Referring specifically to FIG. 9, throat body 179 includes a radially inner inverted frustoconical or converging surface 179*a* defining convergent throat passage 177 and a radially inner cylindrical surface 179*b* extending from surface 179*a* and defining cylindrical throat passage 178. Converging surface 179*a* is oriented at an angle θ relative to central axis 165, and cylindrical surface 179*b* is parallel with central axis 165. Moreover, convergent throat passage 177 has an axial length $L_{177}$ measured parallel to central axis 165, and cylindrical throat passage 178 has an axial length $L_{178}$ measured parallel to central axis 165.

In general, angle θ may be any suitable angle, and axial length $L_{177}$, $L_{178}$ may be any suitable length. However, to achieve the preferred flow characteristics of motive fluid 12 (e.g., supersonic flow), angle θ is preferably no more than 20°, more preferably no more than 15°, and even more preferably no more than 10°. Further, axial length $L_{177}$ of convergent throat passage 178 is preferably between 0.1 in. and 5 in., more preferably between 1.0 in. and 3.0 in., and even more preferably between 1.5 in. and 1.9 in. The ratio of axial length $L_{177}$ to axial length $L_{178}$ preferably ranges from 0.9:1 to 1.1:1.

Referring still to FIG. 9, diverging nozzle 169 extends axially to convergent throat passage 177, and thus, nozzle 169 is in fluid communication with convergent throat passage 177. However, throat body 179 and throat carrier 180 are radially spaced from diverging nozzle 169, resulting in the formation of an annular passage 181 extending axially from annulus 170 to converging throat passage 177 and radially positioned between nozzle body 168 and throat carrier 180. Motive fluid 12 flowing from diverging nozzle 169 flows into convergent throat passage 177, and suction fluids 22 flowing through ports 171 and annuli 170, 181 also flow into convergent throat passage. More specifically, motive fluid 12 pumped from the surface flows through conduit 167 is accelerated to supersonic velocities through converging-diverging nozzles 168, 169. The relatively high velocity of motive fluid 12 at the exit of diverging nozzle 169 and entrance to convergent throat passage 177 results in a relatively lower pressure region that draws or sucks suction fluids 22 in annulus 170 into throat section 175 where suction fluids 22 mix with motive fluid 12 to form exhaust fluid 15 previously described. As suction fluids 22 in annulus 170 are drawn into throat section 175, entrained in motive fluid 12, and carried downstream, a relatively low pressure region forms in annulus 170 that continues to draw or suck upstream suction fluids 22 into annulus 170 via ports 171.

Moreover, the downstream positioning of convergent throat passage 177 and cylindrical throat passage 178 relative to converging-diverging nozzles 168, 169 offers the potential to maintain a relatively high flow rate of exhaust fluid 15 therethrough. In particular, the velocity of exhaust fluid 15 exiting from throat section 178 is preferably at least 0.9 Mach, more preferably at least 0.7 Mach, and even more preferably at least 0.6 Mach. To enable such preferred flow velocities through throat sections 175, 178, the velocity of motive fluid 12 exiting diverging nozzle 169 is preferably at least 1.3 Mach.

Referring again to FIGS. 3, 7, and 9, diffuser section 183 extends axially from throat section 175 to mixed fluid outlet section 187, and includes a divergent passage 184 disposed in housing 176. Divergent passage 184 extends axially from, and is coaxially aligned with, cylindrical throat passage 178. Thus, divergent passage 184 is in fluid communication with throat passage 178.

In this embodiment, divergent passage 184 is formed in a diffuser body 185 that is coaxially disposed within housing 176 and extends axially from throat body 179 to mixed fluid outlet section 187. However, in general, any suitable arrangement and/or assembly of components may be employed to achieve the preferred diverging geometry and arrangement of passage 184.

Referring specifically to FIG. 9, diffuser body 185 includes a radially inner frustoconical or diverging surface 185*a* defining divergent passage 184. Diverging surface 185*a* is oriented at an angle σ relative to central axis 165. Moreover, divergent passage 184 has an axial length $L_{184}$ measured parallel to central axis 165. In general, angle σ may be any suitable angle, and axial length $L_{184}$ may be any suitable length. However, to achieve the preferred flow characteristics of exhaust fluid 15 passing therethrough, angle α preferably between 2° and 4°. Further, axial length $L_{184}$ of divergent passage 184 is preferably between 4 in. and 10 in. and more preferably between 6 in. and 8 in.

Due to the diverging geometry of passage 184, the velocity of fluid exhaust fluid 15 flowing from throat section 175 decreases as it flows through passage 184. For a given mass flow rate through system 100, as the velocity of exhaust fluid 15 decreases, the fluid pressure of exhaust fluid 15 increases as it move through passage 184. The fluid pressure of exhaust fluid 15 at the outlet of passage 184 is preferably sufficient to lift exhaust fluid 15 to the surface. In embodiments, an exhaust fluid (e.g., exhaust fluid 15) pressure at the outlet passage (e.g., outlet passage 184) in absolute units that is less than about half the pressure of the motive fluid (e.g., motive fluid 12) offers the potential to provide sufficient lift of exhaust fluid 15 to the surface.

Figure 8:
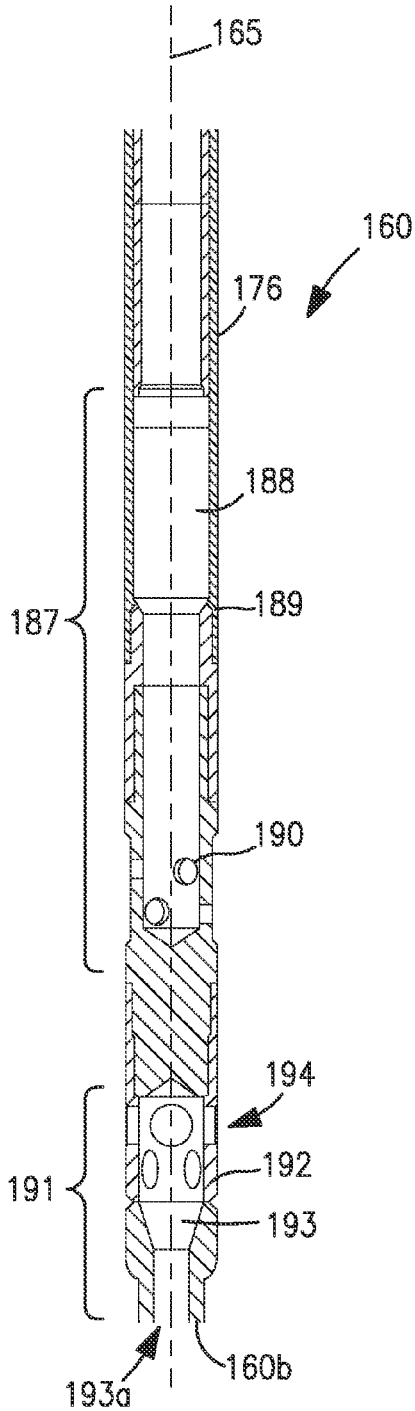

Referring now to FIGS. 3 and 8, mixed fluid outlet section 187 extends axially from diffuser section 183 and includes a central fluid passage 188 in fluid communication with divergent passage 184. Fluid passage 188 extends axially from, and is coaxially aligned with, divergent passage 184. Further, fluid passage 188 is defined by a tubular assembly 189 including housing 176 previously described. Tubular assembly 189 includes a plurality of mixed fluid outlet ports 190 distal diffuser section 183. Ports 190 extend radially through tubular assembly 189 from passage 188. Upon assembly of system 100, outlet ports 190 are axially aligned with outlet port 152 of tubular assembly 140, and thus, passage 188 is in fluid communication with outlet port 152 via one or more outlet ports 190. During operation of system 100, exhaust fluid 15 flows from divergent passage 184 through passage 188 and ports 190, 152 to annulus 152 radially disposed between shroud 155 and tubular assembly 140.

Referring now to FIGS. 4 and 8, suction fluid inlet section 191 is disposed at lower end 160*b* and is axially spaced from outlet section 187. Inlet section 191 comprises a cylindrical body 192 with a central counterbore or passage 193 extending axially from end 160*a*, and a plurality of outlet ports 194 extending radially through body 192 from passage 193 to annulus 153. At end 160*a*, passage 193 defines a fluid inlet 193*a*. As best shown in FIG. 4, the radially outer surface of body 192 is adapted to mate and engage with the radially inner surface of locator 143 when end 160*a* axially abuts shoulder 146, thereby seating ejector assembly 160 in tubular assembly 140.

Upon assembly of system 100, outlet ports 194 are axially aligned with annulus 153, and thus, passage 193 is in fluid communication with annulus 153 via one or more outlet ports 194. During operation of system 100, suction fluids 22 entering system 100 flow through inlet 142 at end 100*b*, through choke 147, and through inlet 193*a* into passage 193. From passage 193, suction fluid 22 flow radially outward through ports 194 to annulus 153. Suction fluid 22 in passage 193 is restricted and/or prevented from flowing directly into mixed fluid outlet section 187.

Referring now to FIGS. 2 and 7, in this embodiment, ejector assembly 160 is axially coupled to a retrieval tool 195 at upper end 160*a*. Retrieval tool 195 is coaxially disposed within passage 141 and has a first or upper end 195*a*, a second or lower end 195*b*, a central fluid passage 196 extending axially from end 195*b*, and a plurality of motive fluid inlet ports 197 extending radially through retrieval tool 195 from passage 196 to an annulus 198 radially positioned between retrieval tool 195 and tubular assembly 140 proximal upper end 140*a*. During operation of system 100, motive fluid 12 flows from wellhead 10 down passage 122 of pipe string 120, through annulus 198, inlet ports 197, and passage 196 to ejector assembly 160.

A capture tool (not shown) is attached to a surface wireline and lowered down passage 122 to connect to retrieval tool 195. This connection allows ejector assembly 160 to be retrieved from tubular assembly 140 and conveyed to surface for maintenance and inspection. The connection is also used to insert ejector assembly into tubular assembly 140. When installing ejector assembly 160 into tubular assembly 140, ejector assembly 160 is lowered into tubular assembly 140, and then wireline is jerked sharply upward to release the capture tool. Application of motive fluid pressure downward insures that ejector assembly 160 seats properly within tubular assembly 140.

The operation of an embodiment of deliquification system 100 will be described. Referring first to FIGS. 1 and 2, to initiate pumping operations, motive fluid 12 is pumped at a relatively high pressure and mass flow rate through wellhead inlet 11 and axially down passage 122 of pipe string 120 to BHA 130. In this embodiment, system 100 is operated with a motive fluid pressure between about 100 and 125 psig and a flow rate between about 80-120 MSCF/day. Motive fluid 12 flows through passage 122 of pipe string 120 and coupling 115 to retrieval tool 195, where motive fluid 12 flows through annulus 198 formed radially between retrieval tool 195 and tubular assembly 140, through inlet ports 197 of retrieval tool 195, and into retrieval tool passage 196.

In general, motive fluid 12 may be any suitable gas that can be pumped downhole at sufficient pressure and mass flow rate to achieve the supersonic velocities in nozzle section 165. However, motive fluid 12 preferably comprises a relatively inexpensive gas that is readily available in the field such as unprocessed natural gas. It should be appreciated that assembly 160 and nozzle assembly 165 may each be referred to as an "ejector" or "ejector assembly" since the nozzle assembly (e.g., nozzle assembly 165) is designed to develop supersonic fluid flow in compressible fluids via the combination of a critical or converging nozzle (e.g., converging nozzle 168) and a diverging nozzle (e.g., diverging nozzle 169). When the motive fluid (e.g., motive fluid 12) exits the converging nozzle it is traveling at 1.0 Mach, however, the downstream diverging nozzle in a sonic flow stream acts to further accelerate the motive fluid flow to supersonic speeds. In contrast, traditional jet pumps are typically classed as "eductors," which means that they are designed for incompressible fluids (primarily liquids) and do not have the means to accelerate the motive or power fluid to speeds in excess of Mach 1.0.

Referring now to FIGS. 2, 3, and 9, from passage 196, motive fluid 12 flows axially downward through passage 164 of motive fluid inlet section 162 to nozzle section 165. Next, motive fluid 12 flows through inlet conduit 167, converging nozzle 168, and diverging nozzle 169. With sufficient pressure and mass flow rate, monitored and controlled from the surface 13, motive fluid 12 is accelerated in converging-diverging nozzles 168, 169 to achieve supersonic flow velocity. The relatively high velocity motive fluid stream exiting diverging nozzle 169 creates a "no-flow boundary" relative to the suction fluid 22 in annulus 181. Suction fluid 22 at the no-flow boundary is accelerated to a significant fraction of the velocity of motive fluid 12. This creates a low pressure region where the suction fluid has been accelerated and more suction fluid 22 flows into the void and is consequently accelerated and so forth. Suction fluid 22 that is accelerated enters convergent throat passage 177 and is further accelerated by the geometry of the narrowing cross section. At the end of the convergent throat passage 177 the combined suction fluid 22 and motive fluid 12 (i.e., the exhaust fluid 15) are allowed to mix within the cylindrical throat passage 178.

Referring now to FIGS. 3, 4, 8, and 9, suction fluid 22 flows axially upward through inlet 142 and choke 147, which regulates the flow rate of suction fluid 22 into system 100. From choke 147, suction fluid 22 flows into suction fluid inlet section 191. Specifically, suction fluid 22 flows axially through inlet 193*a* and passage 193, and then radially outward through ports 194 to annulus 153. From annulus 153, suction fluid 22 flows axially upward through passage 150 of fluid flow separation sub 148 and annulus 154 to ports 171 in housing 166 of nozzle section 165. Next, suction fluid 22 flows radially inward through ports 171 to annulus 170, and axially downward through annulus 170 to annulus 181 and the entrance of convergent throat passage 177.

Referring still to FIGS. 3, 4, 8, and 9, in convergent throat passage 177, suction fluid 22 is entrained by and carried along with motive fluid 12, thereby forming exhaust fluid 15. Within throat section 175, exhaust fluid 15 flows axially downward through divergent passage 177, and straight passage 178 to divergent passage 184 of diffuser section 183. The velocity of exhaust fluid 15 flowing out of throat passage 178 is determined primarily by the quantity of suction fluid 22 but is generally less than 0.5 Mach.

Exhaust fluid 15 flows through straight passage 178 of throat section 175 to divergent passage 184 of diffuser section 183. Within divergent passage 184, the velocity of exhaust fluid 15 decreases. In particular, exhaust fluid 15 slows to a subsonic velocity in divergent passage 184. Exhaust fluid 15 continues to flow axially downward through divergent passage 184 and passage 188 of tubular assembly 189 to ports 190. Next, exhaust fluid 15 flows radially outward through ports 190 of ejector assembly 160 and port 152 of tubular assembly 140 into annulus 157 radially positioned between tubular assembly 140 and shroud 155.

Referring now to FIGS. 2-4, within annulus 157, exhaust fluid 15 flows axially upward to ports 129 in pipe string 125 and radially inward through ports 129 to annulus 127 radially disposed between pipe string 125 and pipe string 120. Then, exhaust fluid 15 flows axially upward through annulus 127 to wellhead outlet 14. As previously described, the velocity of exhaust fluid 15 decreases in divergent passage 184 of diffuser section 183. As a result, the pressure of exhaust fluid 15 increases (for a given mass flow rate through system 100). The geometry of the various passages of system 100 (e.g., divergent passage 184), and the pressure and mass flow rate of motive fluid 12 pumped from the surface 15 are preferably controlled to such that the pressure increase of exhaust fluid 15 in divergent passage 184 is sufficient to drive or power exhaust fluid 15 to the surface 15 and wellhead 10.

In general, the various components of system 100 may be made from any suitable material(s) including, without limitation, metals and metal alloys (e.g., steel), non-metals (e.g., ceramics), composites (e.g., carbon fiber-epoxy composite), or combinations thereof. However, the components of system 100 preferably comprises materials with sufficient integrity, strength, corrosion resistance, and durability for use in anticipated downhole environments. Further, those components of system 100 that define flow passages (e.g., throat body 179, nozzle body 172, etc.) are preferably made from durable, abrasive resistant materials such as tungsten carbide to reduce the potential for premature erosion.

One or more sensors may be employed in system 100 to monitor various surface and downhole parameters. For example, sensors at the surface may be employed to monitor motive fluid mass flow rate and pressure at the wellhead, exhaust fluid pressure and mass flow rate at the wellhead, etc. Further, downhole sensors may be employed to monitor downhole temperatures, flow velocities, pressures, etc.

To further illustrate various illustrative embodiments of the present invention, the following examples are provided.

EXAMPLE 1

A deliquification system in accordance with the principles described herein was constructed. A number of tests were run to: (1) evaluate choke size; (2) evaluate the downhole ejector assembly as a gas compressor; (3) evaluate the downhole ejector assembly as a pump; and (4) evaluate the downhole ejector assembly with a combined gas and liquid stream.

The effect of choke size was investigated. The suction choke is an important component of the entire system as it will tend to prevent large slugs of water from overpowering the ejector and stopping it from working. Tests were run at ⅛", ¼", and ⅜" choke diameter. The ⅜" choke did not result in any throttling in the flow ranges the pump is capable of producing. The ⅛" choke would only allow about half the capacity of the pump (i.e. at 30 MCF/d the choke showed a 70 psig dP). The ¼" choke showed some throttling from about half the pump capacity all the way to the total pump capacity. At full capacity, the amount of throttling was about ⅓ of the compression ratios that the ejector can develop. The ¼" choke was used for all of the following data collection.

Figure 11:
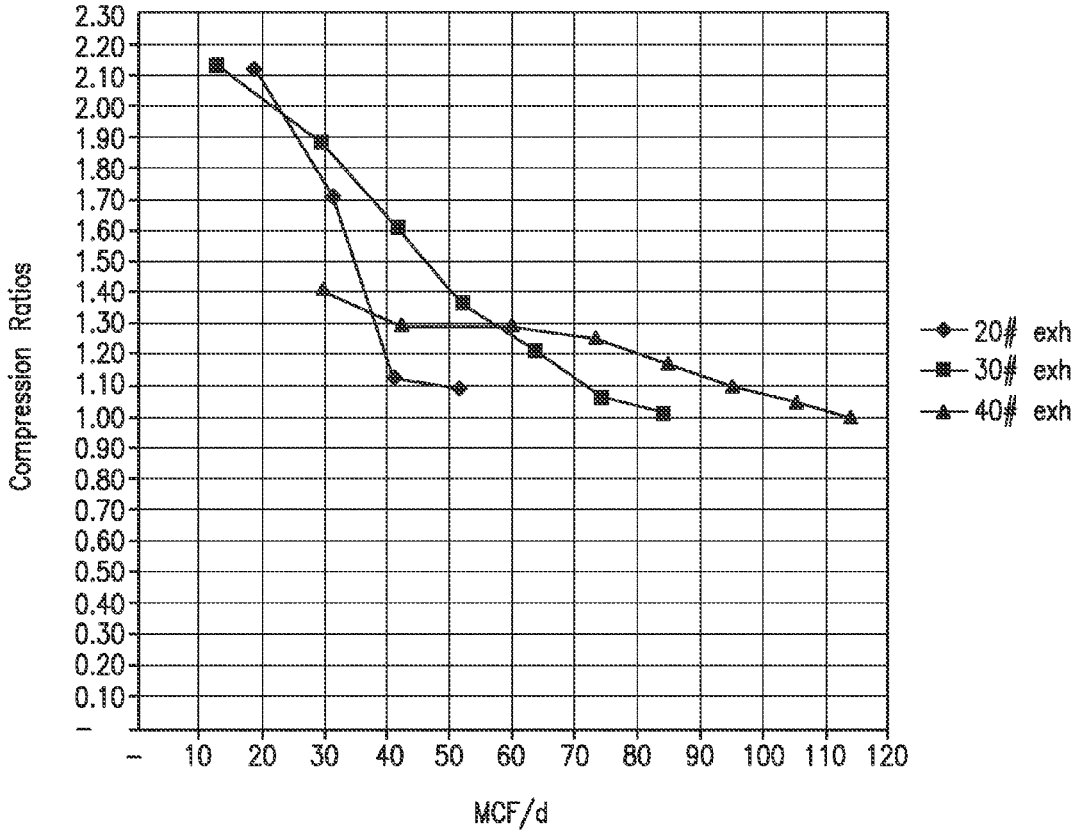
FIG. 11 is a graphical illustration of the results of compression tests run with an embodiment of a deliquification system in accordance with the principles described herein.

The gas compression tests all had approximately the same motive fluid rate. The exhaust pressure was fixed for a test run, and the suction gas flow rate was adjusted in about 10 psig increments (the choke allowed suction flow rate to be controlled by changing supply pressure). When the suction pressure began to overwhelm the pump capacity the run was stopped and the exhaust pressure was changed for the next test. The results are shown in FIG. 11. This data shows that reasonable performance can be achieved by the downhole ejector. At 10-20 MCF/d, the ejector developed a compression ratio over 2.0 at both 20 psig exhaust pressure and 30 psig exhaust pressure.

Figure 12:
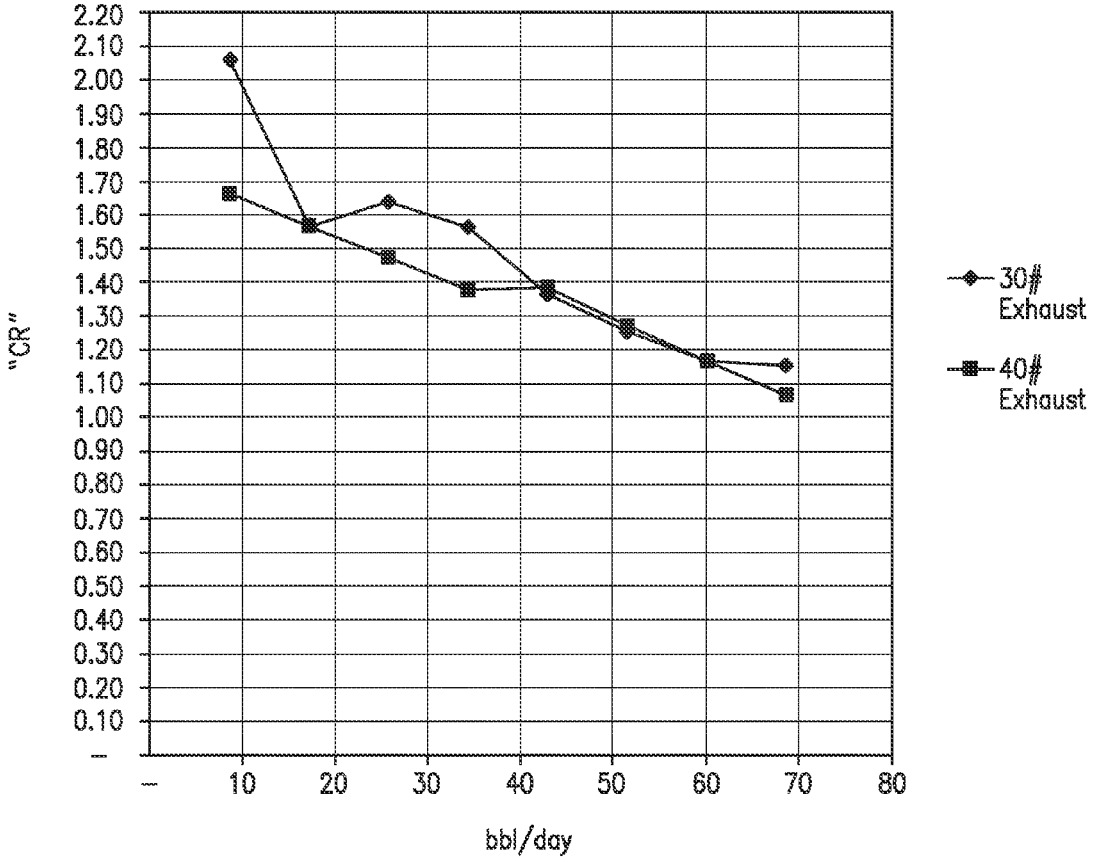
FIG. 12 is a graphical illustration of the results of pumping tests run with an embodiment of a deliquification system in accordance with the principles described herein.

The pump test was done using a similar procedure as the compressor test. City water was used from a hydrant and the pressure was more variable than was desirable, but the results showed that this variability did not pose problems for the ejector assembly. One model predicted 30 bbl/day at 1.4 "compression ratio" while another model predicted 15 bbl/day (with subsonic gas flow). Results of the test are shown in FIG. 12.

Figure 13:
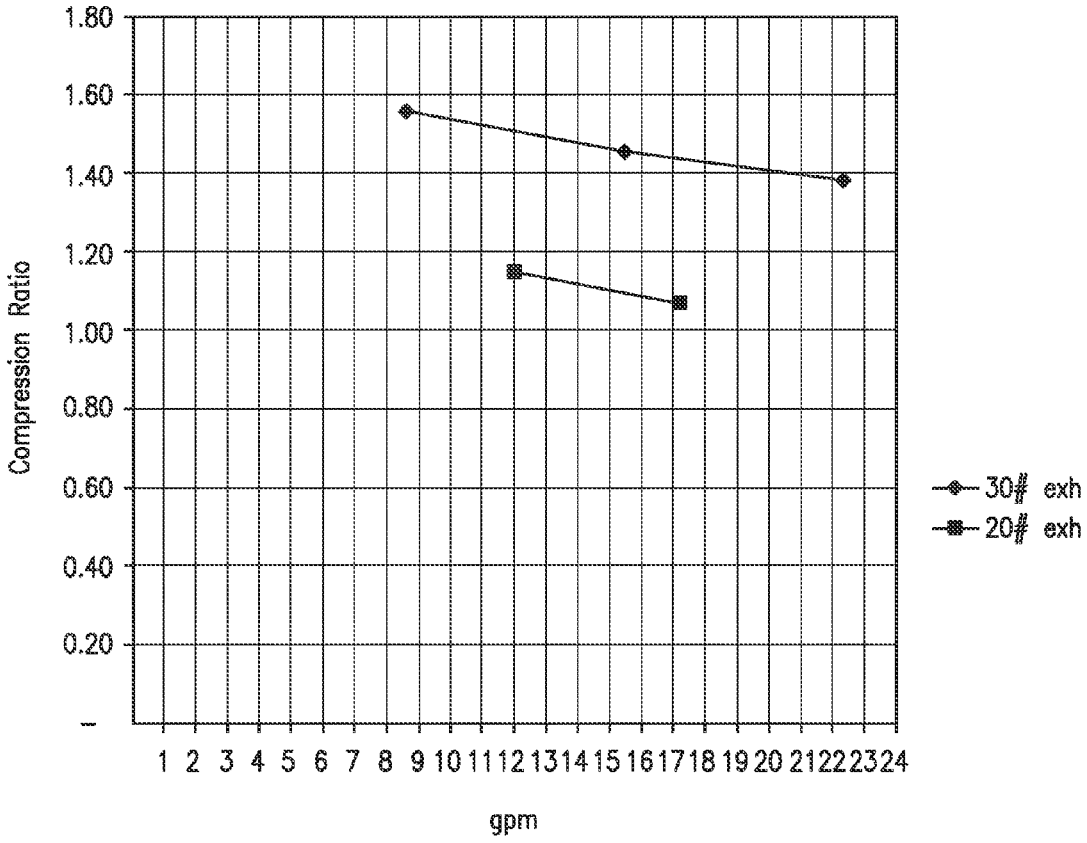
FIG. 13 is a graphical illustration of the results of a combined gas and water flow test using an embodiment of a deliquification system in accordance with the principles described herein.

To be able to run both gas and water streams, a ⅛" choke was installed on the suction gas leg and left the ¼" choke on the combined flow. Using this configuration, 33 MCF/d of air was flowed into the process without overwhelming the city water system's ability to supply water. 33 MCF/d was used for all water flow rates and both back pressure settings. In mass flow rate terms 33 MCF/d is about equal to about 8 bbl/day. As shown in FIG. 13, this test indicated that the ejector was effective with the kind of mixture of fluids typically encountered downhole. With a mixture of gas and liquid on the suction side of the pump, traditional jet pumps have a tendency to stop pumping and damage the throat section. This test showed that the tested downhole ejector was not prone to similar damage.

The final test was a cavitation test. In this test we shut the suction valves and let the ejector run for an hour. It was very interesting that the suction pressure dropped within 30 minutes to 0.5 psig and stayed there for the rest of the test. A suction pressure that low in a jet-pump configuration using water as the power fluid would have destroyed the throat through cavitation within 10-15 minutes. After an hour, we reestablished gas flow at 30 MCF/d and the conditions immediately returned to the gas compression curve above (1.7 CR for 30 MCF/d at 20 psig exhaust). The throat showed the same tool marks that came from the machine shop, but no cavitation. The nozzle also showed no wear.

While the embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The discussion of a reference is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A downhole assembly for deliquifying a wellbore, the assembly having a longitudinal axis and comprising:

a tubular assembly of a bottom hole assembly;

an ejector assembly coaxially disposed within the tubular assembly wherein the ejector assembly includes:

a nozzle section including a converging nozzle and a diverging nozzle in fluid communication with the converging nozzle;

a throat section including a convergent throat passage proximal the diverging nozzle and a straight throat passage distal the diverging nozzle and extending axially from the convergent throat passage;

wherein the convergent throat passage and the straight throat passage are in fluid communication with the diverging nozzle;

a diffuser section coaxially aligned with the throat section, wherein the diffuser section includes a divergent diffuser passage extending axially from the straight throat passage; and a tubular housing extending axially from the converging nozzle to the diffuser section, wherein the converging nozzle, the diverging nozzle, the converging throat passage, the straight throat passage, and the divergent diffuser passage are coaxially disposed within the housing;

wherein the housing includes an exhaust port extending radially through the housing and axially positioned below the diffuser section; and wherein the tubular assembly includes an exhaust port that is axially aligned with the exhaust port of the housing of the ejector assembly, and wherein the exhaust port in the tubular assembly extends radially through the tubular assembly from the exhaust port in the housing to a first annulus between the housing and a shroud.

2. The assembly of claim 1, wherein the diverging nozzle extends axially from the converging nozzle.

3. The assembly of claim 2, wherein the throat section is coaxially aligned with the diverging nozzle.

4. The assembly of claim 1, wherein the converging nozzle is defined by a frustoconical surface oriented at an angle $\alpha$ relative to the longitudinal axis, wherein the angle $\alpha$ is between 6° and 10°.

5. The assembly of claim 4, wherein the diverging nozzle is defined by a frustoconical surface oriented at an angle $\beta$ relative to the longitudinal axis, wherein the angle $\beta$ is less than or equal to 10°.

6. The assembly of claim 5, wherein the converging nozzle has a length $L_1$ measured parallel to the longitudinal axis and the diverging nozzle has a length $L_2$ measured parallel to the longitudinal axis; and wherein the ratio of the length $L_1$ to the length $L_2$ ranges from 16 to 20.

7. The assembly of claim 6, wherein the length $L_2$ is between 0.01 in. and 0.5 in.

8. The assembly of claim 6, wherein the length $L_2$ is between 0.02 in. and 0.10 in.

9. The assembly of claim 1, wherein the convergent throat passage is defined by a frustoconical surface disposed at an angle $\theta$ relative to the longitudinal axis, wherein the angle $\theta$ is less than or equal to 15°.

10. The assembly of claim 9, wherein angle $\theta$ is less than or equal to 10°.

11. The assembly of claim 9, wherein the convergent throat passage has a length $L_3$ measured parallel to the longitudinal axis and the straight throat passage has a length $L_4$ measured parallel to the longitudinal axis, wherein the ratio of the length $L_3$ to the length $L_4$ ranges from 0.9 to 1.1.

12. The assembly of claim 1, wherein the converging nozzle and the diverging nozzle are radially spaced from the housing.

13. The assembly of claim 12, further comprising a second annulus radially positioned between the diverging nozzle and the housing, wherein the second annulus is in fluid communication with the converging throat passage.

14. The assembly of claim 13, wherein the housing includes a port extending radially through the housing and in fluid communication with the second annulus.

15. A system for lifting an accumulated fluid from a wellbore to the surface, comprising:

a first pipe string extending into the wellbore;

a second pipe string extending into the wellbore, wherein the second pipe string has an inner flow passage and is disposed within the first pipe string;

a bottomhole assembly having an upper end coupled to the first pipe string, a lower end including a fluid inlet, and a longitudinal axis, and wherein the bottomhole assembly comprises:

a tubular assembly extending from the upper end to the lower end; and an ejector assembly disposed within the tubular assembly, wherein the ejector assembly includes:

a nozzle section including a converging nozzle and a diverging nozzle extending axially from the converging nozzle, wherein the converging nozzle and the diverging nozzle are in fluid communication with the inner flow passage of the second pipe string;

a throat section coupled to the nozzle section, wherein the throat section is axially positioned below the nozzle section and includes a convergent throat passage proximal the diverging nozzle and a straight throat passage extending axially from the convergent passage;

wherein the convergent passage and the straight passage are in fluid communication with the diverging nozzle;

a diffuser section coupled to the throat section, wherein the diffuser section is axially disposed below the throat section and includes a divergent diffuser passage extending axially from the straight throat passage;

a tubular housing extending axially from the converging nozzle to the diffuser section, wherein the converging nozzle, the diverging nozzle, the converging throat passage, the cylindrical throat passage, and the divergent diffuser passage are coaxially disposed within the housing;

wherein the housing includes an exhaust port extending radially through the housing and axially positioned below the diffuser section;

wherein the tubular assembly includes an exhaust port that is axially aligned with the exhaust port of the housing of the ejector assembly, and wherein the exhaust port in the tubular assembly extends radially through the tubular assembly from the exhaust port in the housing to a first annulus between the housing and a shroud.

16. The system of claim 15, wherein the shroud is disposed about a lower end of the first pipe string and the bottomhole assembly and wherein the shroud extends axially from an upper end that sealingly engages the first pipe string and a lower end that sealingly engages the tubular assembly.

17. The system of claim 16, wherein the first annulus is radially positioned between the shroud and the tubular assembly, and axially positioned between the upper end and the lower end of the shroud.

18. The system of claim 15, further comprising a second annulus radially positioned between the first pipe string and the second pipe string, wherein the first annulus is in fluid communication with the divergent diffuser passage and the second annulus.

19. The system of claim 18, wherein the ejector assembly further comprises a third annulus radially positioned between the diverging nozzle and the housing, wherein the third annulus is in fluid communication with the converging throat passage.

20. The assembly of claim 19, wherein the housing includes a port extending radially through the housing and in fluid communication with the third annulus and the fluid inlet.

21. The system of claim 15, wherein the ejector assembly is retrievably disposed within the tubular assembly.

22. The system of claim 21, further comprising a retrieval tool coupled to the ejector assembly.

23. The system of claim 15, further comprising a choke disposed in the tubular assembly proximal the fluid inlet, wherein the choke is adapted to restrict the flow of a suction fluid into the fluid inlet.

24. The system of claim 15, wherein the converging nozzle is defined by a frustoconical surface oriented at an angle $\alpha$ relative to the longitudinal axis, and the diverging nozzle is defined by a frustoconical surface oriented at an angle $\beta$ relative to the longitudinal axis, wherein the angle $\alpha$ is between 6° and 10° and the angle $\beta$ is less than or equal to 10°.

25. The system of claim 24, wherein the converging nozzle has a length $L_1$ measured parallel to the longitudinal axis and the diverging nozzle has a length $L_2$ measured parallel to the longitudinal axis; and wherein the ratio of the length $L_1$ to the length $L_2$ ranges from 16 to 20.

26. The system of claim 25, wherein the convergent throat passage is defined by a frustoconical surface disposed at an angle θ relative to the longitudinal axis, wherein the angle θ is less than or equal to 15°.

27. The system of claim 26, wherein the convergent throat passage has a length $L_3$ measured parallel to the longitudinal axis and the straight throat passage has a length $L_4$ measured parallel to the longitudinal axis, wherein the ratio of the length $L_3$ to the length $L_4$ ranges from 0.9 to 1.1.

28. A method for deliquifying a well, comprising:

(a) deploying a bottom hole assembly comprising a tubular assembly; an ejector assembly having a longitudinal axis and coaxially disposed within the tubular assembly, the ejector assembly comprising: a nozzle section including a converging nozzle and a diverging nozzle extending axially from the converging nozzle; a throat section coaxially aligned with the diverging nozzle, wherein the throat section includes a convergent throat passage proximal the diverging nozzle; a diffuser section coaxially aligned with the throat section, wherein the diffuser section includes a divergent diffuser passage; a tubular housing extending axially from the converging nozzle to the diffuser section, wherein the converging nozzle, the diverging nozzle, the converging throat passage, the straight throat passage and the divergent diffuser passage are coaxially disposed within the housing; wherein the housing includes an exhaust port extending radially through the housing and axially positioned below the diffuser section; and wherein the tubular assembly includes an exhaust port that is axially aligned with the exhaust port of the housing of the ejector assembly, and wherein the exhaust port in the tubular assembly extends radially through the tubular assembly from the exhaust port in the housing to a first annulus between the housing and a shroud (b) flowing a motive gas through the converging nozzle;

(c) flowing the motive gas through the diverging nozzle after (b);

(c) accelerating the motive gas to a supersonic velocity; and (d) flowing the motive gas through the convergent throat section after (b).

29. The method of claim 28, wherein (d) further comprises entraining a suction fluid in the motive gas to form an exhaust fluid.

30. The method of claim 29, wherein the supersonic velocity of the motive gas in (c) is at least 1.1 Mach.

31. The method of claim 29, further comprising:

providing a first pipe string, wherein the first pipe string has an upper end coupled to a wellhead at the surface and a lower end coupled to the ejector assembly;

disposing a second pipe string within the first pipe string, wherein the second pipe string includes an inner flow passage;

forming a second annulus between the first pipe string and the second pipe string;

flowing the motive gas from the wellhead down the inner flow passage of the second pipe string to the converging nozzle; and flowing the exhaust fluid through the upward through the second annulus to the wellhead.

* * * * *